United States Patent [19]

Grass

[11] Patent Number: 4,799,289

[45] Date of Patent: Jan. 24, 1989

[54] HINGE FRAME WITH EASILY-RELEASABLE ATTACHMENT OF THE FURNITURE-SIDE COVER BRACKET TO THE FURNITURE PIECE

[75] Inventor: Alfred Grass, Höchst, Austria

[73] Assignee: Alfred Grass Ges.m.b.H. Metallwarenfabrik, Austria

[21] Appl. No.: 911,462

[22] Filed: Sep. 25, 1986

[30] Foreign Application Priority Data

Mar. 6, 1986 [DE] Fed. Rep. of Germany ..... 3607406
Jul. 19, 1986 [DE] Fed. Rep. of Germany ..... 3624237

[51] Int. Cl.[4] ..... E05D 7/06; E05D 7/12; E05D 7/04

[52] U.S. Cl. ..... 16/236; 16/240; 16/258; 16/261; 16/268; 16/270; 16/272; 16/292; 16/297; 16/356; 16/382

[58] Field of Search ..... 16/236, 240, 243, 255, 16/256, 257, 258, 261, 262, 268, 270, 272, 292, 297, 355, 356, 382

[56] References Cited

FOREIGN PATENT DOCUMENTS 360856 6/1980 Fed. Rep. of Germany .
3119571 5/1981 Fed. Rep. of Germany ..... 16/258

*Primary Examiner*—Nicholas P. Godici
*Assistant Examiner*—Edward A. Brown

[57] ABSTRACT

A quick-assembly hinge frame with easily releasable attachment of the furniture-side cover bracket to a mounting plate attached to a furniture piece will be described, in which the connection between the releasable part of the hinge frame and the piece firmly attached to the furniture side is made by a detent engagement. For ease of quick assembly a pivot connection between the base plate of the hinge frame and the mounting plate is provided on the end nearest the door, and on the end furthest from the door a locking side is provided which has an open detent which pivots under spring pressure into the locked position thus connecting the base plate in a quick-release fashion with the mounting plate.

11 Claims, 10 Drawing Sheets

45
61
58
59
82
12

81
13
10
8
18
73
57
54
69
53
75
60
17
76
74
62
63
70
84
56
55
78
85
86
54
68
72
31
30
14
67
66
83
65
71
80
79
77
52
64
50
51

HINGE FRAME WITH EASILY-RELEASABLE ATTACHMENT OF THE FURNITURE-SIDE COVER BRACKET TO THE FURNITURE PIECE

BACKGROUND OF THE INVENTION

The invention concerns a hinge frame in accordance with the preamble of patent claim 1.

The object of the invention is to provide a quick-assembly hinge frame whose hinge cup is firmly attached to the inside of a door part and which can be quickly connected to the inside of the furniture by the cover bracket which is flexibly-mounted on the hinge cup.

Such a hinge frame of this layout is known in that for quick-assembly of the hinge frame onto a mounting plate on the furniture side, a retaining spring was present between the quick-release part of the hinge frame and the firmly attached mounting plate and that the hinge frame was locked onto the mounting plate by pressing the quick-release part onto the mounting plate thus locking it with the spring. The spring was released by the pressure of the hinge frame on the mounting plate and thus locked with the hinge frame.

A disadvantage of this known type of quick-locking assembly was that a greater work load ensured in that a relatively high locking pressure between the releasable part of the hinge frame and the fixed part must be used and must be compensated for by a restraining pressure of the hand to avoid movement of the furniture piece on the place of assembly.

One therefore had to restrain the furniture piece with one hand and the door with the other hand ensuring at the same time that the releasable part of the hinge frame was pressed onto the mounting plate with considerable force during assembly.

BRIEF SUMMARY OF THE INVENTION

The invention is based on the technical problem of designing a hinge frame with quick-release attachment of the furniture-side cover bracket to mounting plate attached to the furniture in a simple and reliable manner.

This problem is solved by forming the quick-release connection of the door-side releasable part of the hinge frame to the stationary part on the furniture from a pivot connection attached near the door and a spring-loaded detent engagement away from the door.

It is introduced here as a definition of terms that the complete hinge frame consists of a releasable part and a fixed part. The term "releasable part" indicates the part of the hinge frame which basically consists of the cover bracket, the hinge levers and the hinge cup connected to them. This part is identified as "releasable" because it is connected to the door and thus the door can be removed from the piece of furniture.

The "fixed part" of the hinge frame is understood to be the part of the hinge frame which is firmly attached with the corresponding assembly screws to the piece of furniture.

An essential feature of the invention is, therefore, that a two-point attachment will be proposed which on the one side consists of a pivot connection between the releasable part and the fixed part of the hinge frame arranged near the door, and which on the other side consists of a detent arrangement on the end away from the door which is releasable by hand pressure.

In accordance with the subject matter of claim 2 it is preferred that the detent arrangement at the end away from the door consists of a locking slide arranged on the releasable part of the hinge frame, which can be force-locked to a part of the mounting plate firmly attached to the furniture side.

There are several alternative types for such a locking slide.

In one case it is preferred if the locking slide is formed as a rotary slide whereby a rotary movement achieves the necessary detent engagement between the releasable part of the hinge frame and the fixed part, and in another case it is preferred that the locking slide is formed as a lengthwise slide which after the style of a locking key can only be slid in a straight line and in this way also achieves an easily released but highly loadable connection between the releasable part of the hinge frame arm and the fixed part.

It is important for all forms of the locking slide that it has wedge faces which function in the direction of sliding in such a way that as the locking stroke of the locking slide increases, the wedge faces make a correspondingly stronger connection with the fixed part of the hinge frame arm.

With increasing movement of the locking slide in the locking direction the desired connection is therefore strengthened.

It is further essential that the locking slide, either as a rotary or longitudinal slide, is spring-loaded in the locking direction so that it automatically engages in the locking direction under spring pressure creating an ever-increasing strengthening of the connection with the fixed part of the hinge frame arm.

A further essential feature of the present invention is that the locking slide locks into the open position, i.e. therefore remains in the open position against spring pressure and that this open detent can be released by hand pressure whereby the locking slide according to the invention either rotates or slides under spring pressure into its locked position and thus enters into an ever-increasing strengthening of the connection with the fixed part of the hinge frame arm as previously described.

An advantage of this arrangement is easy operation of the locking slide in that the open detent ensures simple operation, and a further advantage is that even with increasing operational life and thus increasing wear of the hinge frame arm, this connection never loosens but is always reinforced by spring pressure so that wear makes no difference.

In the case of the present invention two fundamentally different versions of such a detent arrangement between the releasable part of the hinge frame and the fixed part of the hinge frame arm will be further described.

A first embodiment example is, that on the quick-release door-side attached part of the hinge frame arm, pins are provided which act together with the corresponding conical openings on the fixed part of the hinge frame.

The pivot connection arranged near the door between releasable part of the hinge and the firmly attached part of the hinge on the furniture side consists of two conical openings, which are open in the direction of the door side and which taper conically to the end away from the door, in the area of two parallel legs of the mounting plate attached to the furniture. Into these conical openings engage associated pins which are each arranged on the inner side of two parallel legs arranged on a base plate attached to the releasable part of the hinge frame which overlaps the mounting plate.

The releasable part of the hinge frame attached to the door is therefore introduced initially into the conical opening in which the door is moved in the direction of the furniture piece. After engagement of the pins in the parallel conical openings the pins are automatically led into the base of both conical openings and can pivot there so that the releasable part of the hinge frame can be so pivoted that the part of the hinge frame away from the door can be swung onto the part of the mounting plate attached to the furniture away from the door. The releasable part of the hinge frame then lies exactly parallel to and above the mounting plate attached to the furniture, and it is now only necessary to release the open detent of the locking slide with finger pressure whereby it slides out under spring pressure and the wedge faces engage under the associated shoulders in the area of the mounting plate. In this way the desired releasable connection between the releasable part of the hinge frame and the fixed mounting plate is simply and quickly produced.

A second embodiment example is that the mounting plate attached to the furniture is formed from two pieces and consists of a mounting plate lower portion firmly attached to the furniture piece which is releasably-connected, by means of the detent engagement according to the invention, with a mounting plate upper portion.

The hinge frame is then pushed onto the mounting plate upper portion where it is adjustable within specific limits along the longitudinal axis of the hinge frame. This adjustment permits the depth of the door to be adjusted in relation to the furniture piece.

An advantage of the two-piece formation of the mounting plate attached to the furniture is that further hinge frames can be pushed on to the mounting plate upper portion which is connectable to the hinge frame in an adjustable fashion. The mounting plate upper portion is so shaped in the this embodiment example that, for example, a hinge frame can be pushed into it which has a "C" profile, which with two opposite and parallel legs forming a reciprocal distance between them can be slid onto the mounting plate upper portion.

This achieves the advantage of ensuring a universal attachment by use of a two-piece mounting plate in that the mounting plate upper portion can be matched to suit all currently known hinge frames so that all known hinge frames can be connected in adjustable fashion to the mounting plate upper portion.

The detent engagement according to the invention is only between the mounting plate lower portion and the mounting plate upper portion in this embodiment example.

Thus arise unexpected advantages during the assembly of doors to furniture, which were not previously known.

In addition to the possibility of a quick connection between the door part and the furniture part by means of the locking detents in accordance with the invention in which this quick connection can be made without tool and using only minimal force, the further advantage arises in that the mounting plate lower portion is already pre-assembled rigidly on the inner side of the furniture piece.

The mounting plate upper portion is attached in a pre-determined middle position on the hinge frame where the hinge frame is itself connected to the door part.

The door part can even be connected to the furniture part in the factory in that the door part is brought onto the furniture part on the assembly line and the mounting plate upper portion on the hinge frame can be locked to the mounting plate lower portion on the furniture piece by hand pressure.

Therefore the necessity of final assembly of the complete furniture at the customer can be dispensed with. Furthermore attachment and assembly screws do not get lost in that all parts are secure, i.e. the mounting plate lower portion is attached to the furniture piece and on the door part, the hinge frame is secured to the mounting plate upper part.

The subject of the present invention arises not only out of the subjects of the individual patent claims, but also from a combination of the individual patent claims one with another. All the details and features disclosed in the documents, particularly those illustrated in the three-dimensional drawings, are claimed as being essential to the invention in so far as they are, either individually or in combination, new as compared with the state of the art.

In the following, the invention will be further explained by means of drawings illustrating merely one embodiment example. Further features and advantages essential to the invention arise from the drawings and their descriptions.

BRIEF DESCRIPTION OF THE SEVERAL VIEWS OF THE DRAWINGS

FIG. 3. Side view of the mounting plate.

FIG. 3*a*. View in the direction of the arrow III A of the face of the mounting plate in FIG. 3.

FIG. 4. Plan view of the mounting plate in accordance with FIG. 3.

FIG. 9. Section through the intermediate plate on the line IX—IX in FIG. 10.

DETAILED DESCRIPTION

Figure 1:
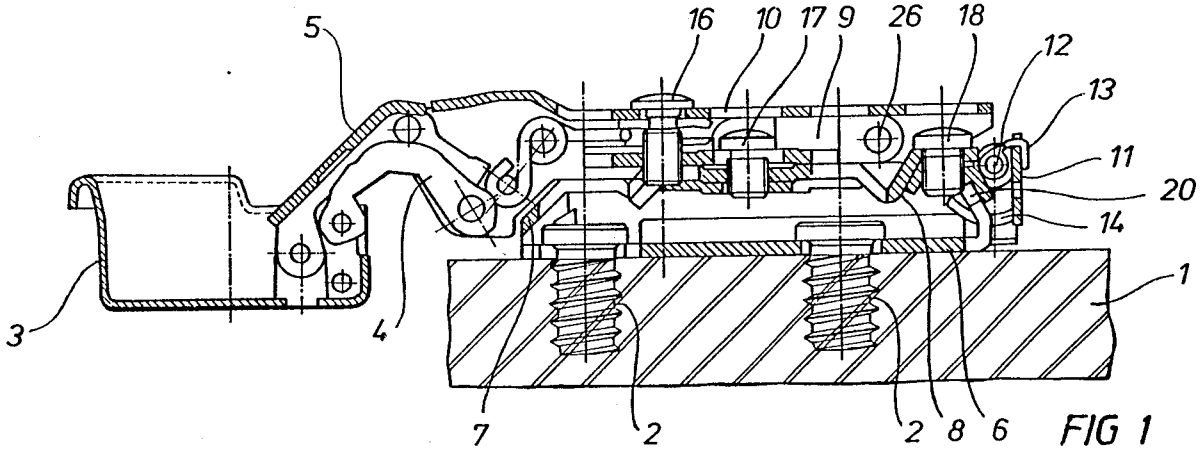
FIG. 1. Longitudinal centre line section of a hinge frame according to the invention.

With reference to the two embodiment examples described in the following, attention is drawn to the fact that the inventive idea is not to be understood as limited to the embodiment examples. The previously explained inventive idea should rather encompass all embodiment examples which are relevant to the quick assembly of a releasable part of a hinge frame with a part of the hinge frame secured to a furniture piece. Hereunder comes not only the previously described two-joint hinge but also a one-joint hinge and the like.

Thus in the following embodiment examples merely one specific embodiment type of a two-joint hinge adjustable in three directions will be described.

In accordance with FIG. 1, the hinge frame has a mounting plate (6) fixed to the furniture piece (1) by two attachment screws (2), which will be described in detail using FIGS. 3, 3*a* and 4.

This mounting plate (6) represents the part of the hinge fixed to the furniture piece (1) whereas the remaining parts of the hinge frame represent the parts releasable from the furniture piece (1).

The releasable parts here consist of a base plate (7) which has, on the end near the door, a pivot mounting with the mounting plate (6) and, on the end away from the door, a locking slide which is formed as a rotary slide (11) in the embodiment example.

The base plate (7) is, on its side, connected to an intermediate plate (8) which is slidable vertical to the longitudinal axis of the hinge and can be locked to the base plate (7) and is secured to it. The adjustment of the intermediate plate (8) relative to the base plate (7) is made here by a height adjustment screw (18).

An adjustment plate (9) is arranged above the intermediate plate (8) which enables the angular adjustment of the releasable part of the hinge frame in relation to the furniture piece (1). The angular adjustment is carried out by an angle adjustment screw (16) whereby the adjustment plate (9) has a drilling (26)(Ref.FIG.13) which is engaged by a shaft which itself is mounted in the cover bracket (10) arranged above the adjustment plate. In this way the adjustment plate (9) is mounted in the cover plate (10) so as to be angularly adjustable (pivotable relative to the drilling 26).

The cover bracket (10) has, on its end near the door, two levers (4)(5) which are pivot mounted to a hinge cup (3) by their opposing bearings. The hinge cup (3) is let into the door part in a fashion not further explained.

It is to be mentioned that the length adjustment screw (17) enables adjustment of the cover bracket (10) in the longitudinal direction of the hinge frame.

On the end of the base plate (7) away from the door, one axle (12) of the rotary slide (11) is mounted which is pre-loaded into the locking position by means of a spring (13).

The rotary slide (11) is shown in the closed position in FIG. 1 and engages with its two parallel and adjacent locking openings (14) (merely one locking opening (14) is visible in FIG. 1) under the associated shoulder (20) of a tab (15) which is rigidly fixed to the mounting plate (6) and is bent up obliquely from the plane of the mounting plate.

It can be seen that the shoulder (20) of the lug (15) of the mounting plate (6) comes to rest on a shoulder (24) of the base plate (7) which has the same oblique angle to ensure security of the hinge against longitudinal movement, also however, it enables an adjustment of the base plate vertical to the longitudinal axis of the hinge frame in relation to the mounting plate (6).

Figure 2:
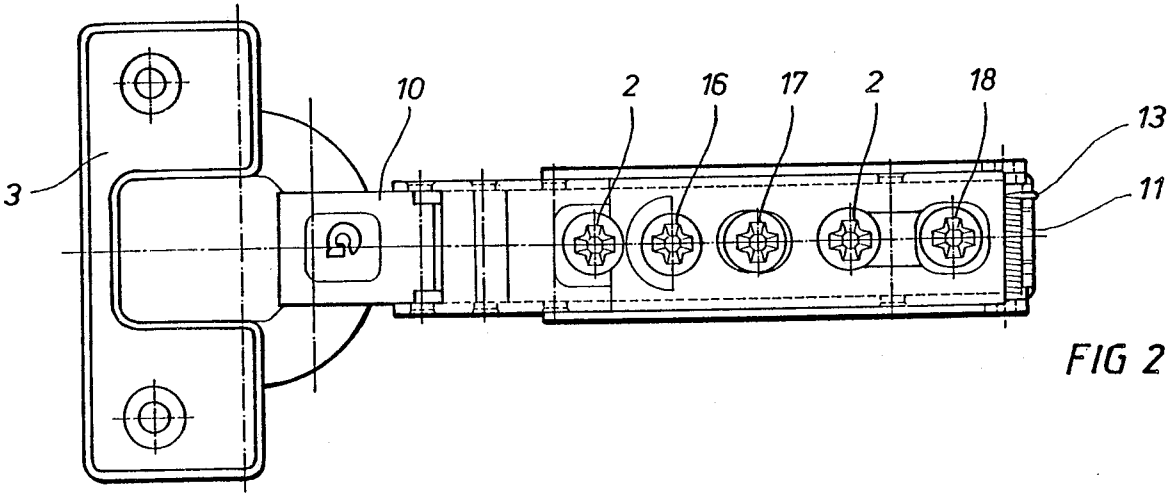
FIG. 2. Plan view of a hinge frame in accordance with FIG. 1.

FIG. 2 shows the plan view of the hinge frame in FIG. 1 in which the individual already-described screws can be seen. Further the rotary slide (11) can also be seen arranged on the end of the base plate (7) away from the door, which is spring-loaded into the locked position by the spring (13).

FIG. 3 shows a side view of the mounting plate (6) firmly attached to the furniture (1).

The mounting plate (6) is a U-section part with two opposite and parallel legs (36)(37). In each leg of the mounting plate (6), on its end nearest the door, a conical opening (19) is machined. In these openings (19) the base plate (7) is inserted in the direction of arrow (40) whereby the base plate (7) is likewise formed as a U-section in accordance with FIGS. 5 to 8 whose side legs (38) (39) go over the legs (36)(37) of the mounting plate (6).

Thus the pins (22) arranged on the inner sides of the legs (38) (39) tilted inwards, engage in the conical openings (19) of the legs (36)(37) of the mounting plate thus forming a rotary-pivot mounting of the base plate (7) relative to the fixed mounting plate (6). Because of this pivot mounting it is now particularly simple to push the base plate (7) onto the mounting plate (6) in that the pins (22) are first pushed into the conical openings (19) which taper towards the end nearest the door, thus making it impossible to inadvertantly lift the base plate (7) off the mounting plate (6) during assembly.

It is then possible to swivel the base plate (7) in the direction of arrow (41) over the mounting plate (6) whereby the pivot axis is the pins (22) in the conical openings (19).

When the pivot movement is completed, the base plate (7) assumes the position shown in FIG. 1 relative to the mounting plate (6), i.e. for security of location the shoulder (24) fits over the mounting plate (6) shoulder (20) at the same angle.

The lugs (15) bent up from the plane of the mounting plate (6) now form the fixed locking position on the furniture side of the mounting plate (6) in relation to the releasable part of the hinge frame, that is relative to the base plate (7) and the rotary slide (11) arranged on the base plate.

In accordance with FIG. 3*a*, the lugs (15) are T-shaped, i.e. on the free, upper end of the lugs (15) opposite shoulders (20) are formed, below which (corresponding to the T-shape of the lugs) are openings.

These opening serve as engagements for the locking openings (14) arranged in parallel, of the rotary slide (11) which will be explained in detail using FIGS. 20 to 22.

The rotary slide (11) is hereby secured in a pivoting fashion on the end of the base plate (7) away from the door by an axle (12), in which the axle (12) is secured in the mounting eyes (23) and the mounting eyes (23) are formed in the area of the opposite shoulders (25) of the legs (38)(39).

Figure 10:
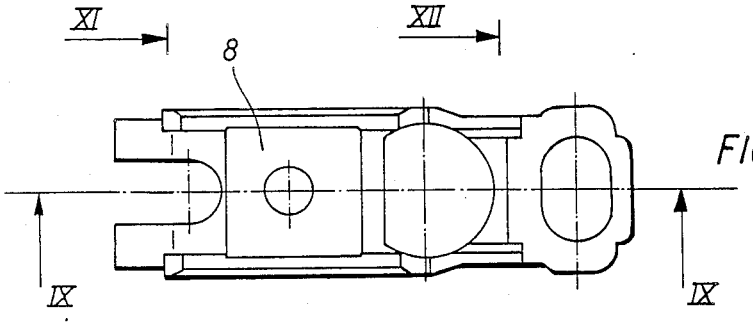
FIG. 10. Plan of the intermediate plate in accordance with FIG. 9.

FIGS. 9 and 10 show the intermediate plate (8) which is secured to the base plate (7) in a sliding fashion vertical to the longitudinal axis of the hinge frame.

Figure 11:
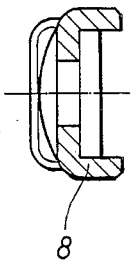
FIG. 11. Section on the line XI in FIG. 10.
Figure 12:
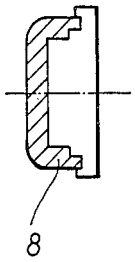
FIG. 12. Section on the line XII in FIG. 10.

To simplify the shape of the intermediate plate (8) FIGS. 11 and 12 only show sections through it.

Figure 17:
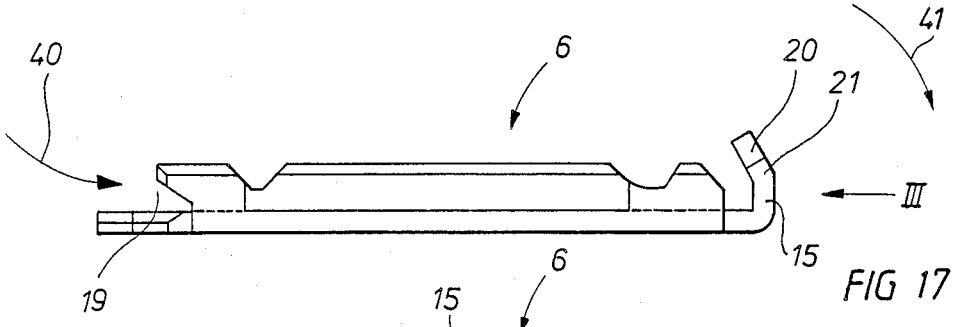
FIG. 17. Plan view of the cover bracket in accordance with FIG. 16.
Figure 17A:
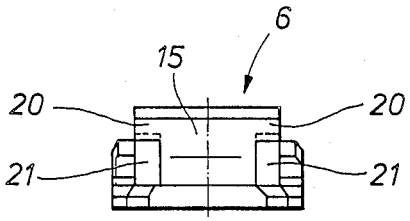
Figure 18:
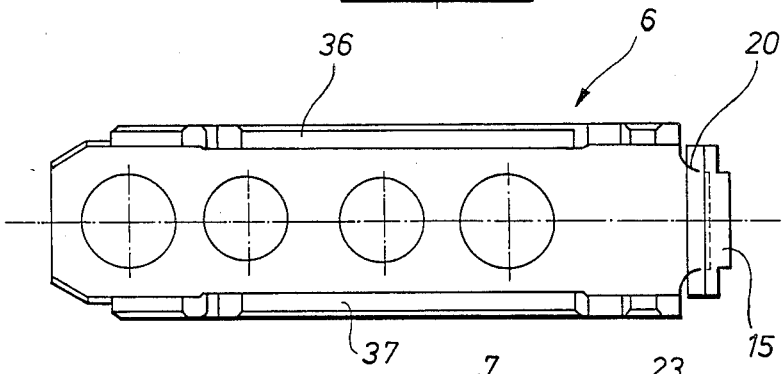
FIG. 18. Section on the line XIII—XVIII in FIG. 16.
Figure 5:
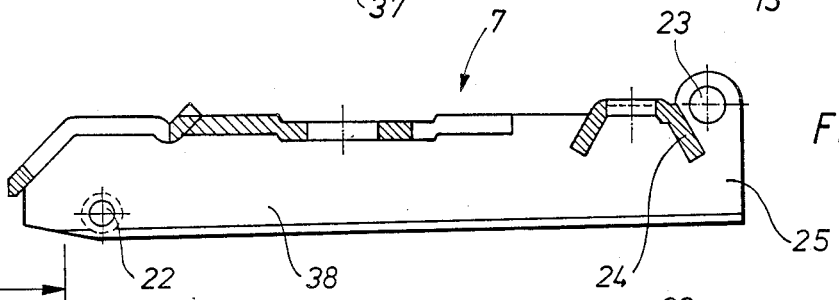
FIG. 5. Section through the base plate of the hinge frame in the direction of arrow V—V in FIG. 6.
Figure 6:
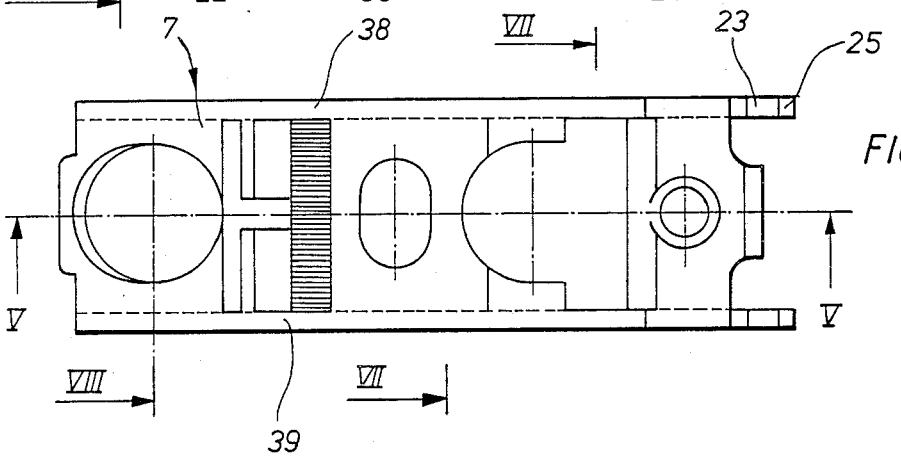
FIG. 6. Plan view of the base plate in accordance with FIG. 5.
Figure 7:
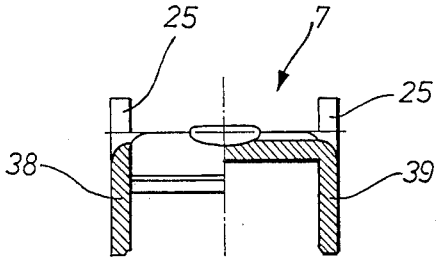
FIG. 7. Section through the base plate on the line VII—VII in FIG. 6.
Figure 8:
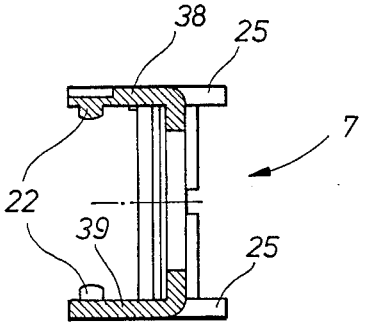
FIG. 8. Section on the line VIII—VIII in FIG. 6.
Figure 13:
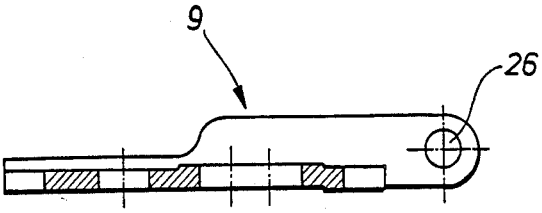
FIG. 13. Longitudinal centre line section through the adjustment plate.
Figure 15:
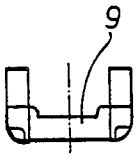
FIG. 15. Section through the adjustment plate.
Figure 14:
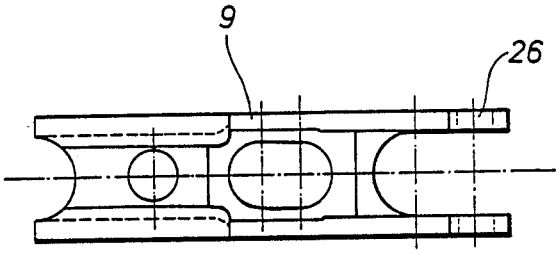
FIG. 14. Plan view of the adjustment plate in accordance with FIG. 13.
Figure 16:
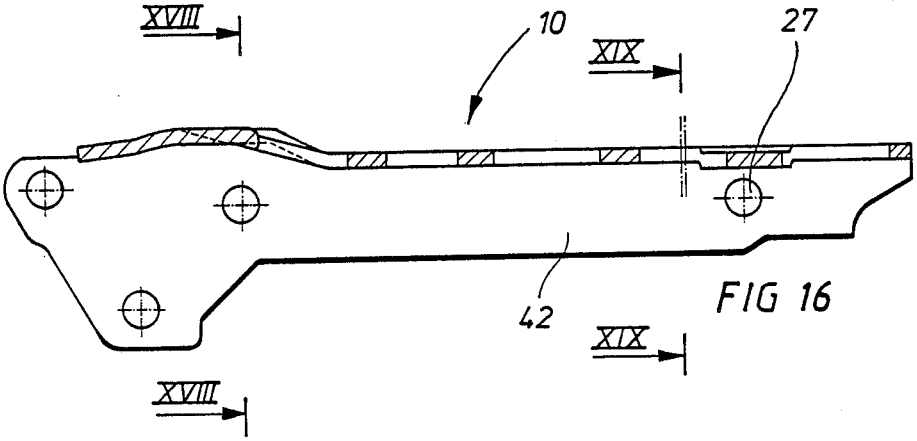
FIG. 16. Longitudinal centre line section through the cover bracket on the line XVI—XVI in FIG. 17.
Figure 17:
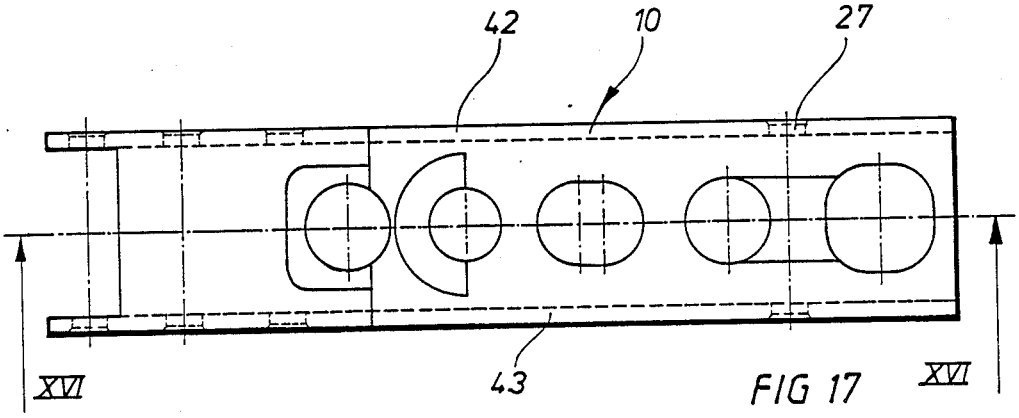
Figure 18:
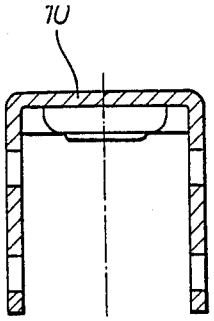
Figure 19:
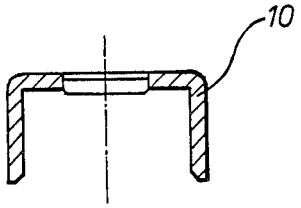
FIG. 19. Section on the line XIX—XIX in FIG. 16.

FIGS. 13 to 15 show the angularly adjustable adjustment plate (9) which, on its end away from the door, has drillings for engagement of the pins (27), in which the pins (27) are arranged in the opposing legs (42)(43) of the cover bracket (10) as shown in FIGS. 16 and 17. When the pins (27) are engaged in the corresponding drillings (26) of the adjustment plate (9) it is thus mounting in an adjustable fashion relative to the cover bracket (10).

Figure 20:
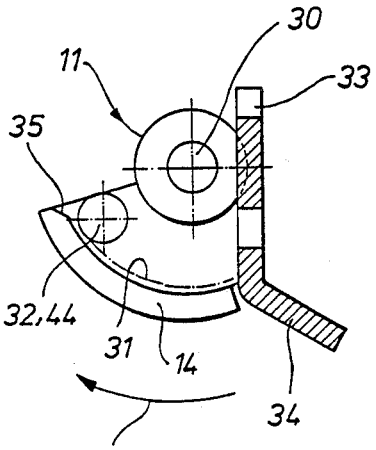
FIG. 20. Section on the line XX—XX through the rotary slide in accordance with FIG. 22.
Figure 21:
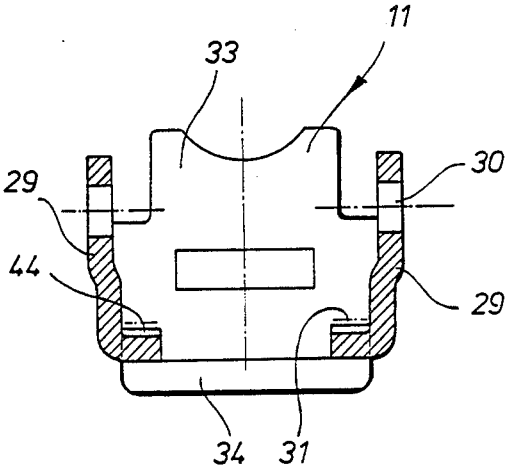
FIG. 21. Section on the line XXI—XXI through the rotary slide in accordance with FIG. 22.
Figure 22:
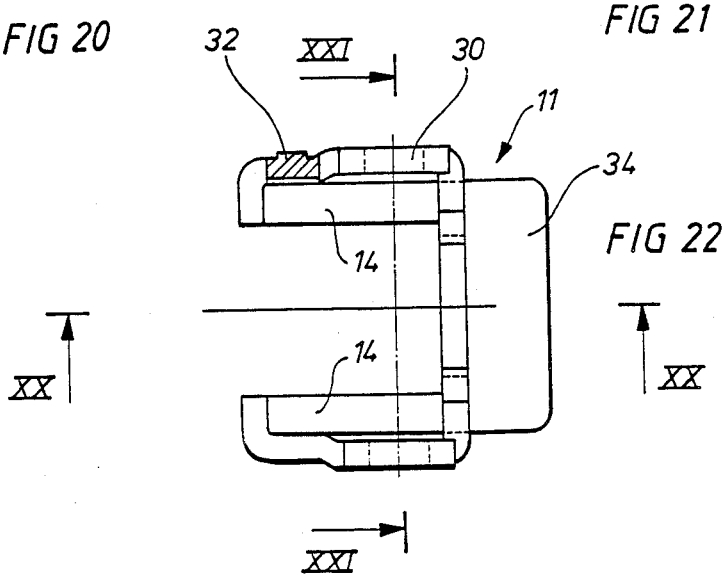
FIG. 22. Plan view and partial section of the rotary slide.
Figure 23:
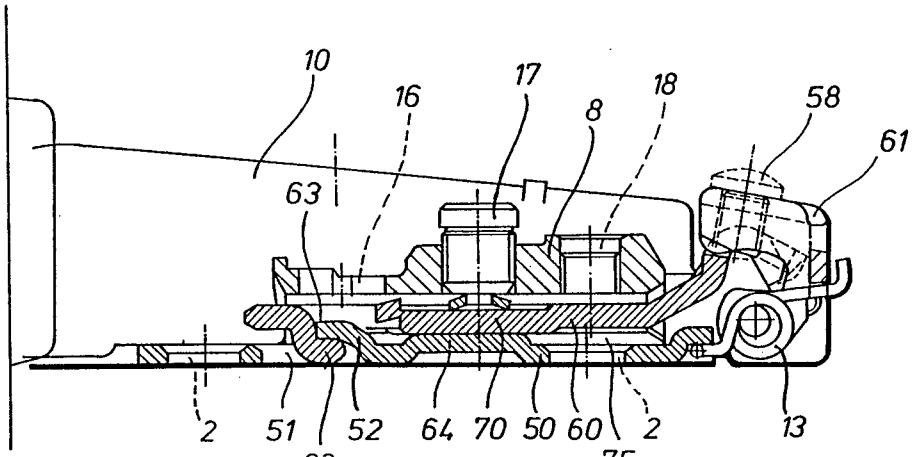

FIGS. 20 to 22 show in detail the rotary slide (11) which is connected in pivoting fashion with the base plate (7).

It consists, in accordance with FIGS. 21 and 22, of a U-shaped part with opposing legs (29). In the legs (29) are opposing aligned drillings (30) through which an axle (12) passes, which is secured in the opposing legs (38)(39) of the base plate (7).

The rotary slide (11) has, on its end away from the door, as a base leg, an operating lug (33) whose lower end goes over a shoulder (34) which is bent obliquely rearwards. This shoulder simplifies the positioning and operation of the rotary slide (11) into its inwards pivoted locking position.

On the inside of and parallel to the legs (29) of the rotary slide (11) two locking openings (14) are arranged, in which each locking opening has the machined shape shown in FIG. 20, i.e. it is basically of circular path shape in which each locking opening (14) has, on its edge, a wedge point (35) which simplifies the positioning of the base plate (7) in the openings (21) below the shoulders (20) on the lugs (15).

The radius (44) shows that circular path shaped locking openings (14) engage under the shoulders (20) on the lugs (15) so that the seating faces (31) on the inside of the locking wedges (14) seat on the underside of the shoulders (20).

It is important here that the seating surfaces are not precisely concentrically mated to the drilling (30) but rather eccentrically, i.e. as the pivoting of the locking openings (14) increases in the direction of arrow (45) (locking direction), the seating surface (31) approaches the drilling (30) radially, whereby increased pivoting in the direction of arrow (45) ensures that the seating faces (31) wedge themselves with increasing strength on the shoulders (20). This is achieved because the centre of the circular path of the locking openings (14) lies eccentrically to the axle (12).

The wedging in arrow direction (45) is made by the force of a multipl-winding spring (13) which is shown in FIG. 1 in section and in plan view in FIG. 2.

The rotary slide (11) also has an open detent which ensures that it can be locked in the open position with the base plate (7).

For this purpose a knob (32) is formed on the outside of one leg (29) of the U-shaped part (28) which can be locked into the open position with a raised portion (not further explained) of the base plate (7) on the inside of the leg (39).

By means of pressure on the rotary slide in the direction of arrow (45) this open detent is released and the rotary slide pivots automatically under the force of the spring (13) in the direction of arrow (45) into its locked position whereby the seating faces (31) which are arranged eccentrically to the axis (drilling (30)), lie with increasing strength under the shoulders (20) of the lugs (15) in the mounting plate (6).

Thus a self-strengthening, quick-release connection between the base plate (7) and the mounting plate (6) is always achieved, which even with continuous use does not move or become loose.

In the case of the second embodiment example of a hinge frame with a detent arrangement according to the present invention now to be described, merely the furniture-side part of the hinge frame is explained. With reference to its three-dimensional adjustment possibilities and its attachment to the door, this hinge frame is identical with the hinge frame previously described by means of FIGS. 1 to 23.

Additionally, the parts of the embodiment example according to FIGS. 23 to 36 have the same index numbers as the corresponding parts of the embodiment example according to FIGS. 1 to 22.

It is characteristic of the embodiment example described in the following that the furniture-side attachment of the cover bracket (10) is achieved by a two-piece mounting plate, in which the mounting plate consists of a mounting plate lower part (50) which is connected to the furniture piece (1) by corresponding attachment screws (hidden detail in FIG. 23).

The mounting plate upper part (60) can be secured on the mounting plate lower part by a two-point attachment to be described in the following:

One point of the two. point attachment consists of a hook-and-recess connection, arranged on the end near the door, between the mounting plate lower part (50) and the mounting plate upper part (60) whereas the part of the two-point attachment away from the door consists of the detent engagement to be described in the following.

It is to be understood that the hood connection arranged on the end near the door can also be replaced by a connection such as was described in the previous embodiment example with the conical opening (19), in which corresponding pins (22) engage in the base plate (7).

In the previous embodiment example therefore this connection can be replaced by the hook (62)-recess (51) connection in the embodiment example to be described in the following, and vice-versa.

Figure 23:
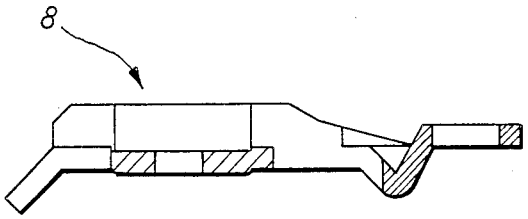
FIG. 23. Section through the furniture-side attachment of a hinge frame in a second embodiment example.

FIG. 23 shows the finished engaged and secured connection between the mounting plate lower part (50) and the mounting plate upper part (60) in which both parts are locked by a rotary slide (61) and the rotary slide is additionally secured against inadvertent opening by a safety screw (58).

The spring-loaded pivoting of the rotary slide (61) in the locking direction is again achieved by the force of the spring (13) which is formed as a multi-winding lever spring.

Using FIG. 25 the attachment of the cover bracket (10) to the mounting plate upper part (60) will be explained first, followed by the two-point attachment, according to the invention, between the mounting plate lower part (50) and the associated upper part (60).

Figure 25:
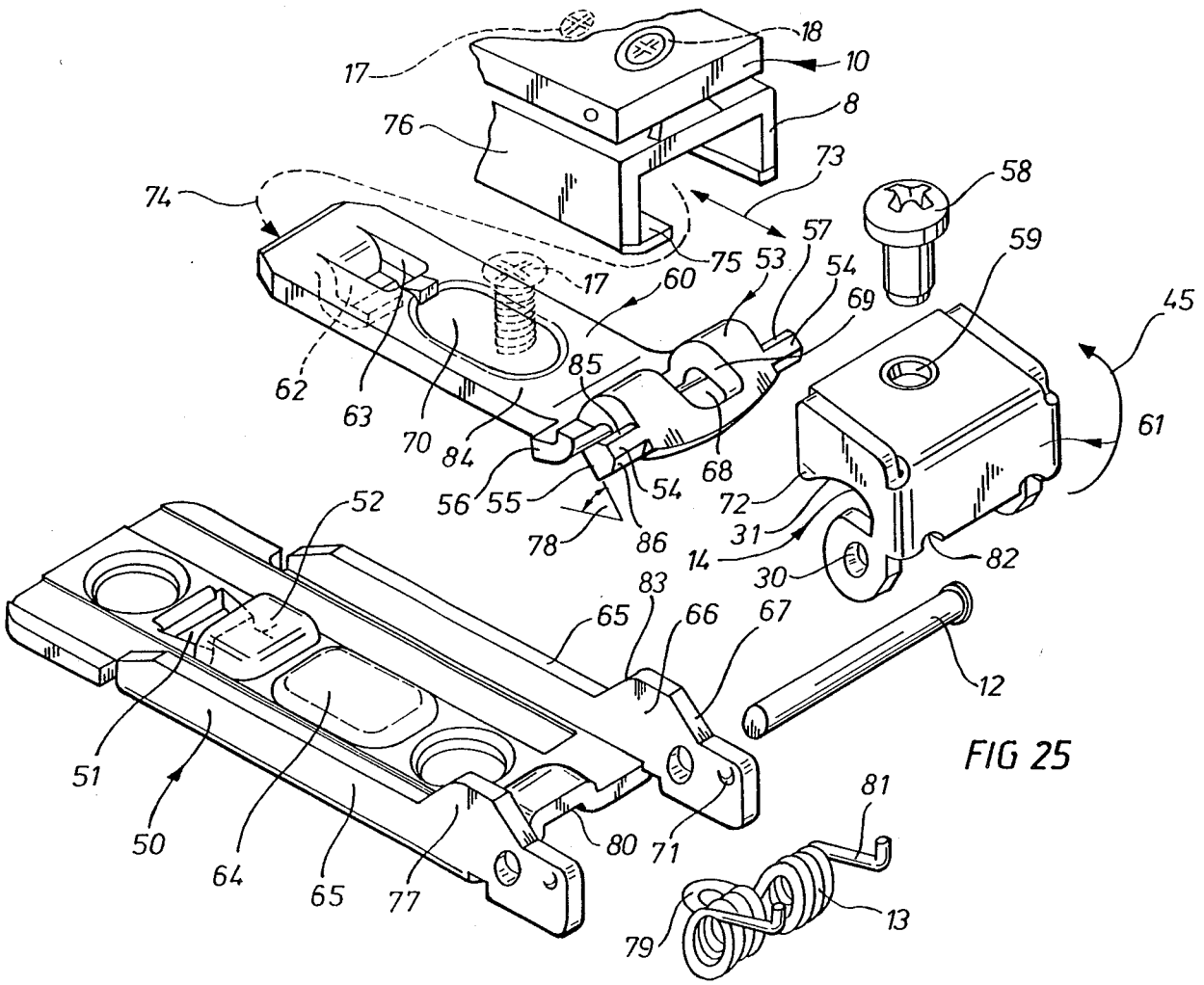
FIG. 25. Perspective exploded view of the furniture-side attachment of the hinge frame in accordance with FIGS. 23 and 24.
Figure 28:
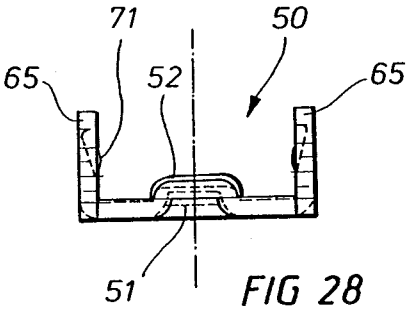
FIG. 28. Front face view of the mounting plate lower portion.
Figure 29:
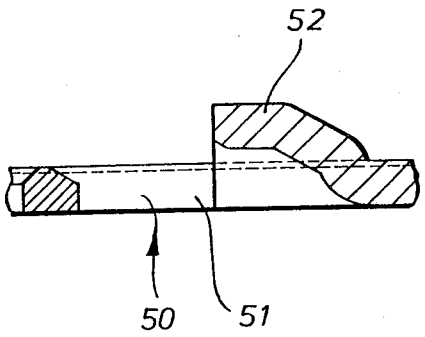
FIG. 29. Enlarged section of a detail of the mounting plate lower portion.
Figure 26:
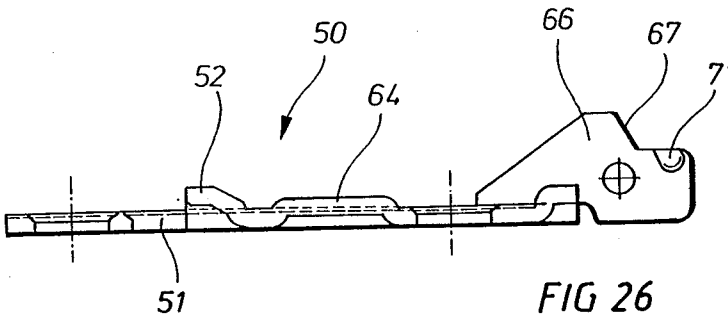
FIG. 26. Side view of the mounting plate lower portion.
Figure 27:
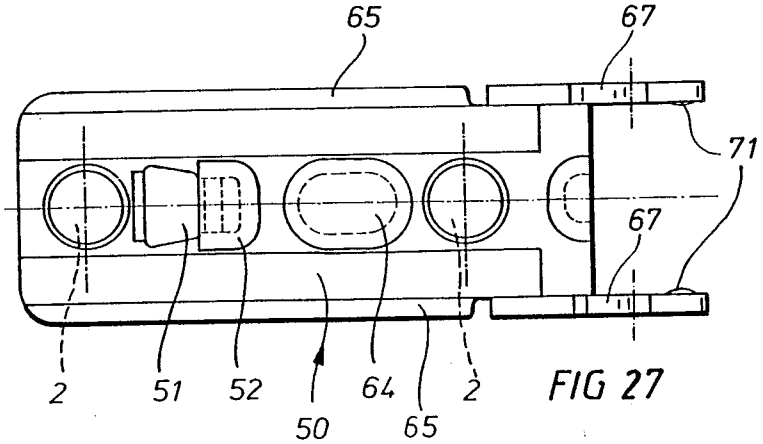
FIG. 27. Plan view of the mounting plate lower portion.
Figure 32:
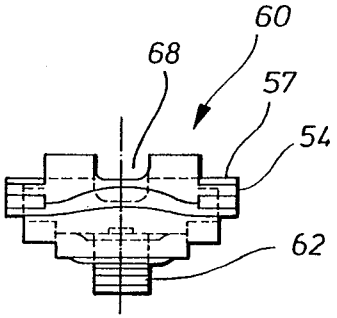
FIG. 32. Front face view of the mounting plate upper portion.
Figure 33:
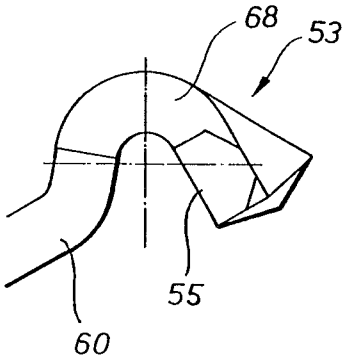
FIG. 33. Side view of the front part of the mounting plate upper part in an enlarged representation as compared with FIG. 30.

In FIG. 25, above left, the rear end of a current cover bracket (10) is illustrated representing the state of the art. In this cover bracket the intermediate plate (8) is formed as a "C" section, so that this "C" section of the intermediate plate (8) can be slid on to the mounting plate upper part (60) in the direction of arrow (74). The opposing shoulders (75) of the "C" section of the intermediate plate (8) then engage under the mounting plate upper part (60) so that it is thus freely slideable, in a depth adjustment direction (73), to the intermediate plate (8).

FIG. 25 shows as hidden detail that this sliding motion in the depth adjustment direction is adjustable by means of length adjustment screw (17). Here the length adjustment screw (17) according to FIG. 1 is connected to the cover bracket and its threaded portion engages, in accordance with FIG. 1, with a threaded hole (not further explained) in the intermediate plate (8) so that the length adjustment screw (17) takes up the position shown by the dotted lines in FIG. 25.

Hereby the threaded end of the length adjustment screw (17) engages in an oval recess (70) in the area of the mounting plate upper part (60).

When the length adjustment screw (17) is loosened the complete cover bracket can be slid in the depth adjustment direction (73) freely in relation to the mounting plate upper part (60). When the length adjustment screw (17) is screwed back in, the face of the length adjustment screw is securely seated in the recess (70) of the upper part (60) and thus the depth of the hinge is adjusted to the furniture piece (1).

So that the side shoulders (75) of the intermediate plate (8) can also engage under the upper part (60) and not come up against the corresponding parts of the mounting plate lower part (50) beneath it, the upper (60) and lower (50) parts have a specific distance from each other which is defined in that the base of the recess (70) lies on the surface of a corresponding raised portion (64) of the mounting plate lower part (50)(as shown in FIG. 23) so that the shoulders (75) engage under the upper part (60) with a clearance.

It is important in the case of the illustrated attachment and adjustment method, that all currently known hinge frames have a C-section intermediate plate so that all known frames can be connected to the two-piece mounting plate (50)(60) according to the invention.

Figure 30:
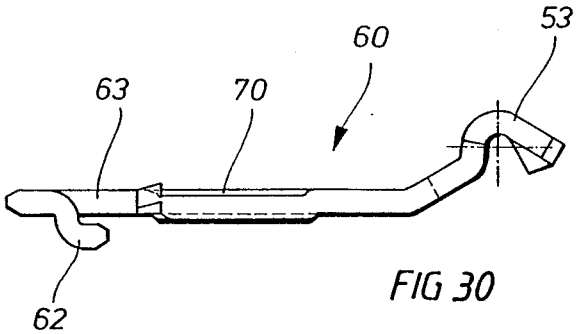
FIG. 30. Side view of the mounting plate upper portion.
Figure 31:
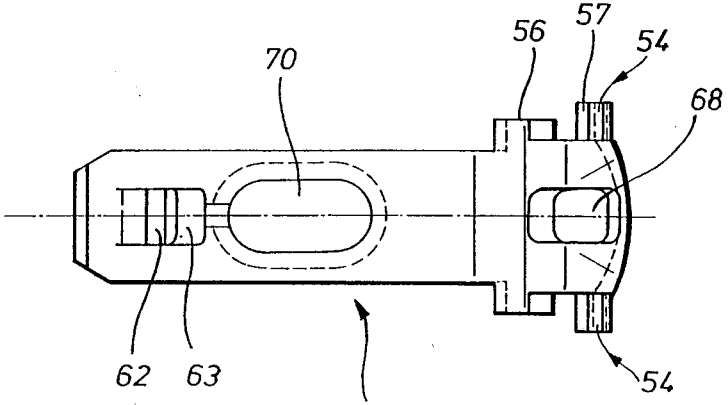
FIG. 31. Plan view of the mounting plate upper portion.
Figure 34:
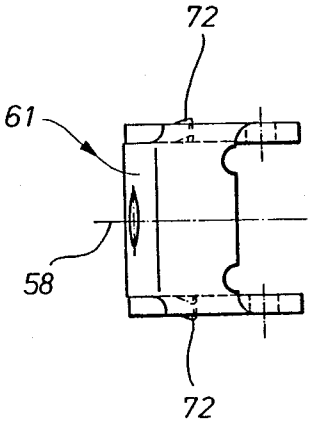
FIG. 34. Plan view of the rotary slide
Figure 35:
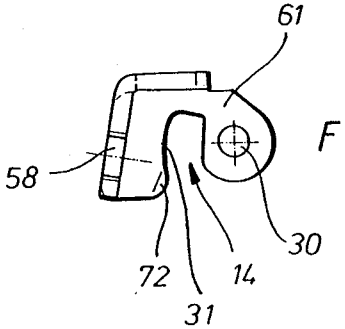
FIG. 35. Side view of the rotary slide.
Figure 36:
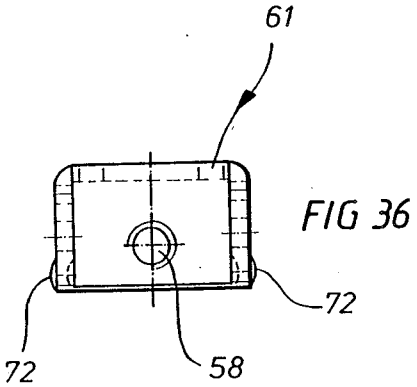
FIG. 36. Front face view of the rotary slide.

In the following the hook-and-recess connection (51)(62) near the door will now be further explained As can be seen from FIGS. 25, 30 and 31, a hole (63) is punched through the mounting plate (60), the resulting metal tongue is then bent to form a hook (62) on the end near the door, which hangs below the plane of the upper part (60).

The hook (62) is made to engage in a recess (51) in the area of the end of the mounting plate lower part (50) near the door, in which the recess (51) according to FIGS. 25, 26, 27 and 29 is achieved by a free punch-out in the surface of the lower part (50) and at the recess, in its front part, is overlapped in the form of a cap by a pressed-out part (52) so that the hooks (62) of the upper part (60) are first inserted into the recess (51) of the lower part (50) and, by a further push on the upper part (60) in the longitudinal direction to the lower part (50) in accordance with the illustration in FIG. 23, engage under the pressed-out part (52) and are secured there against pulling out and lifting.

The purpose of this hook-and-recess connection is that this connection is firstly only used to lock the upper part (60) onto the lower part (50) avoiding pressing on and locking of this connection by hand when offering-up the door to the furniture piece.

This connection is therefore secured against lifting and jumpingout and the final connection of both parts (50)(60) is then achieved by the detent engagement to be described in the following.

The detent engagement between the lower piece (50) and the upper piece (60) is achieved by use of the rotary slide (61) which is spring-loaded by the spring (13) and is mounted, to pivot about the axel (12), on the mounting plate lower part (50).

Figure 24:
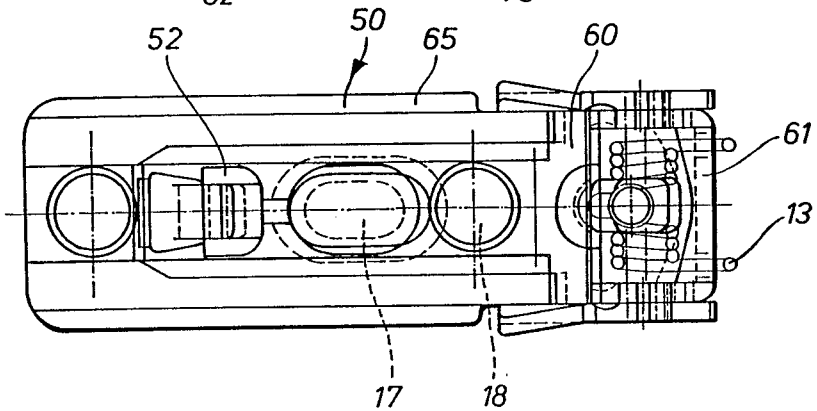
FIG. 24. Plan view of the hinge frame in accordance with FIG. 23.

For the further explanation of the detent engagement, the opposing arrangement of the lower part (50) to the upper part (60) in the final position shown in FIGS. 23 and 24 will first be explained.

The lower part (50) here consists of a longitudinal metal plate on which side walls (65) are formed which serve as guides for the intermediate plate (8) which can be pushed into it. The side faces (76) of intermediate plate (8) lie against the insides of the side walls (65) with a slight clearance, so that the intermediate plate (8) is guided in a slidable fashion on the upper part (60).

The sidewalls (65) are raised in the area away from the door and there become sidewalls (77) which form both inner stop faces (66) and upper stop faces (67) for the upper part (60).

In the locked position shown in FIG. 23, the outer stop faces (56) of the upper part (60) thus lie on the inner stop faces (66) in the region of the sidewalls (77) of the lower part (50).

The upper part (60) forms, on its end away from the door, in accordance with the illustrations in FIGS. 25 and 30 to 33, an arched shaped bend (53), on the front of which lateral lugs (54) which have a greater width than all other parts of the upper part (60).

The lugs (54) are tilted at an angle (78) to the longitudinal axis of the upper part (60) and lie on the identically-angled stop faces (67) in the area of the sidewalls (77) of the lower part.

This special connection of the inner stop faces (55) of the upper part with the corresponding upper stop faces (67) of the lower part (50) in conjunction with the previously described hook-and-recess connection (62)(51) gives an attachment secured against longitudinal movement between the upper (50) and lower (60) parts which now only needs to be secured against lifting by the detent engagement to be further explained in the following.

This is achieved by the rotary slide (61) which is pivot mounted on the axel (12) in the area of the opposing sidewalls (77) of the lower part (50).

The middle part (79) of the spring (13) engages here in a corresponding recess (80) on the front face of the lower part (50) while both spring ends (81) of the spring (13) engage in corresponding cut-outs (82) on the rear part of the rotary slide (61). In this fashion the rotary slide is spring loaded in the locking direction (arrow direction 45).

The rotary slide here has a similar shape to that in the first embodiment example in accordance with FIGS. 20 and 2.

It consists of a U-shaped part in which, in the area of the side walls, the locking opening (14) is arranged in the shape of an arched track. The upper part of the locking opening (14) here forms the seating face (31), which engages over the opposing lugs (54) in the closed position and thus comes into contact with upper, chamfered wedge faces (57) in the area of the lugs (54).

This means that with increasing rotation of the rotary (locking) slide (61), in the direction of arrow (45) a self strengthening joint is created between the seating faces (31) in the area of the locking openings (14) and the associated wedge faces (57) in the area of the lugs (54) on the upper part (60).

For ease of locking, lateral lugs (72) are pressed out in the area of the locking openings (14) in order to engage over the lugs (54) of the upper part (60) with the greatest possible area.

A strengthening of the joint is thus achieved in that the track-shaped locking openings (14) lie eccentric to the pivot-point of the axel (12).

For security of the locked position of the rotary slide (61) a threaded drilling (59) is made in the upper face of the rotary slide in which the threaded portion of a safety screw (58) engages.

To rotate the rotary slide (61) the safety screw (58) is released so that the threaded portion disengages from the corresponding cut-out (69) in the area of the forward bend (53) of the upper part (60).

In the secured position, in accordance with FIG. 23, the safety screw (58) is screwed in so that the threaded portion engages in the cut-out (68) in the bend (53) of the upper portion (60) and thus takes up a position on the edge (69) of this cut-out (68). Thus the rotary slide (61) can not be inadvertantly opened thus giving the highest possible security against a possible falling-off of the door from the furniture.

In order to ensure a simple clipping-on of the upper piece (60) onto the lower piece (50), an open detent of the rotary slide (61) is provided.

Here, the lateral cams (71) are pressed out of the forward end of the sidewalls (77) in accordance with FIG. 25 which act on the outside of the sidewall of the rotary slide (61) with projections (not further explained), so that the rotary slide is held in the open position by these cams. This catch can easily be overcome by hand so that the force of the spring (13) then automatically moves the rotary slide (61) into the closed position in the direction of arrow (45).

It is important that even in the case of a long life of the hinge frame during which repeated opening and closing can cause wear, the detent engagement in accordance with the invention can never loosen as the spring (13) always moves the rotary slide (61) further in the direction of arrow (45) so that a force-locking connection of the eccentrically arranged locking opening (14) with the associated wedge faces (57) in the area of the lugs (54) of the upper part is always present. Thus a force-locking connection, free of play, between the upper part (50) and the lower part (60) is always ensured.

With the hinge according to the invention, therefore, an automatic assembly of the hinge (cover) bracket (10) on the mounting plate (50)(60) on the furniture side is achieved without the necessity for a visual inspection, and without the necessity of both parts having to be hand-guided.

This assembly will be described in the following using FIG. 25:

In its pre-assembly state the hinge bracket (10) with its C-shaped intermediate plate (8), is pushed onto the mounting plate upper part (60) in the direction of arrow (74) in which the length adjustment screw (17) firmly attaches the hinge bracket (10) to the mounting plate upper part (60). The mentioned quick-assembly between the mounting plate upper part (60), which hangs by the hinge bracket (10) on the door part, and the mounting plate lower part (50) secured to the furniture, is now carried out.

For this the mounting plate upper part (60) is placed on the mounting plate lower part (50), without precise alignment, so that the narrower part (84) of the upper part (60) lies between the sidewalls (65) of the lower part (50). In this way the wider lugs (54) engage with their stop faces (56) on the inner stop faces (66) of the side walls (65). The hinge bracket is then slid forwards in arrow direction (73) where the lower rounded-off faces (86) of the wider lugs (54) abut the forward-sloping stop faces (83) in the area of the sidewall (77) of the lower part (50) and are lifted by them. By this lifting movement the lugs (54) engage simultaneously in the locking openings (14) of the rotary slide (61) with the facetted faces (85) provided on the lugs (54) in the area of the forward bend (53) of the upper part (60), the rotary slide (61) being thus automatically pivoted in the opposite direction to arrow (45) into its open position. As soon as the stop faces (55) of the lugs (54) then reach the stop faces (67) sloped in the opposite direction to the stop faces (83), the rotary slide (61), previously pivoted into the open position, pivots into its closed position in arrow direction (45) so that the seating faces (31) of the locking openings (14) engage around the lugs (54) and clamp under spring loading in the direction of rotation (45) with ever increasing clamping strength.

I claim:

1. A quick release hinge frame attached to a furniture piece and a door communicating therewith comprising: mounting plate means secured to the furniture piece; a base plate having a detent engaging shoulder releasably secured to said mounting plate; a door connected cover bracket releasably secured to said base plate; detent means pivotally attached to said mounting plate means; and spring means urging said detent means into a spring loaded engagement with said detent engaging shoulders thereby releasably securing the door to the furniture piece.

2. A hinge frame as claimed in claim 1 wherein said spring means communicates with said mounting plate means.

3. A hinge frame as claimed in claim 1 wherein the connection between said base plate and said cover bracket is adjustable in the longitudinal direction.

4. A hinge frame as claimed in claim 1 wherein the connection between said base plate and said cover bracket is angularly adjustable.

5. A hinge frame as claimed in claim 1 wherein said base plate includes a locking slide engagable with said spring means.

6. A hinge frame as claimed in claim 5 wherein said locking slide is formed as a rotary slide.

7. A hinge frame as claimed in claim 3 wherein said spring means communicates with said mounting plate means.

8. A hinge frame as claimed in claim 7 wherein the connection between said base plate and said cover bracket is adjustable in the longitudinal direction.

9. A hinge frame as claimed in claim 7 wherein said cover bracket is angularly adjustable.

10. A hinge frame as claimed in claim 7 wherein said base plate includes a locking slide engagable with said spring means.

11. A hinge frame as claimed in claim 10 wherein said cover bracket is angularly adjustable.

* * * * *